US012070644B2

(12) United States Patent
Yao

(10) Patent No.: US 12,070,644 B2
(45) Date of Patent: Aug. 27, 2024

(54) DOUBLE-SAFETY ANTI-DROPPING AND ANTI-FRACTURE HOOK FOR ELASTIC BELT

(71) Applicant: Chengjin Yao, Qingdao (CN)

(72) Inventor: Chengjin Yao, Qingdao (CN)

( * ) Notice: Subject to any disclaimer, the term of this patent is extended or adjusted under 35 U.S.C. 154(b) by 154 days.

(21) Appl. No.: 17/857,079

(22) Filed: Jul. 4, 2022

(65) Prior Publication Data

US 2024/0001189 A1 Jan. 4, 2024

(51) Int. Cl.

| | |
|---|---|
| ***A63B 21/055*** | (2006.01) |
| ***A63B 21/04*** | (2006.01) |
| ***A63B 71/00*** | (2006.01) |

(52) U.S. Cl.

CPC ..... *A63B 21/0557* (2013.01); *A63B 21/055* (2013.01); *A63B 71/0054* (2013.01); *A63B 21/04* (2013.01); *A63B 21/0407* (2013.01)

(58) Field of Classification Search

CPC ..... A63B 21/0557; A63B 21/055; A63B 71/0054; A63B 21/04; A63B 21/0407

See application file for complete search history.

(56) References Cited

U.S. PATENT DOCUMENTS

| | | | | |
|---|---|---|---|---|
| 6,120,424 | A * | 9/2000 | Arline | A63B 21/169 482/121 |
| 2011/0111890 | A1* | 5/2011 | Webb | A63B 21/4025 482/124 |
| 2015/0238799 | A1* | 8/2015 | Arline | A63B 21/0442 482/129 |
| 2018/0021624 | A1* | 1/2018 | Cordero | A63B 21/154 601/48 |
| 2018/0043204 | A1* | 2/2018 | Warren | A63B 21/0726 |
| 2018/0093123 | A1* | 4/2018 | Williams | A63B 23/03508 |
| 2018/0304134 | A1* | 10/2018 | Parque | A63B 21/4013 |

* cited by examiner

*Primary Examiner* — Andrew S Lo

(74) *Attorney, Agent, or Firm* — Jose Cherson Weissbrot

(57) ABSTRACT

A double-safety anti-dropping and anti-fracture hook for an elastic belt comprises a main hook body, wherein a small end of the main hook body is provided with a first connecting hole, a big end of the main hook body is provided with a second connecting hole, the second connecting hole runs through the main hook body in a radial direction, and the main hook body is also provided with a tapered hole communicated with the second connecting hole in an axial direction, and a cross section of the tapered hole increases from the big end of the main hook body to the direction of the second connecting hole; and the big end of the main hook body is also provided with a notch, which ensures that the elastic belt will not cause injury to personnel in case of releasing or fracture.

4 Claims, 3 Drawing Sheets

DOUBLE-SAFETY ANTI-DROPPING AND ANTI-FRACTURE HOOK FOR ELASTIC BELT

TECHNICAL FIELD

The present application relates to a double-safety anti-dropping and anti-fracture hook for an elastic belt.

BACKGROUND

Elastic belt is a small physical training tool made of natural latex, which is easy to carry, convenient to use and effective. It is used in the field of fitness, mainly for men's strength training and women's self-cultivation program. It can effectively improve muscle strength, physical activity and flexibility, and effectively improve sports performance. It is also widely used in the field of rehabilitation training to help treat various chronic diseases of human body. When the elastic belt is used, it is often necessary to configure a special hook. One end of the hook is fixed on the immovable object such as the wall, and the other end is connected with the elastic belt, so that the user can stretch the elastic belt to achieve the purpose of exercise. Tubular, flaky or closed-loop elastic rings are commonly used in elastic belt products. For an elastic belt, it is usually quickly connected with the hook by plugging. Although the connection is more convenient, there are some problems such as releasing and elastic belt breakage during use, which pose hidden dangers to the personal safety of users.

SUMMARY

In view of the shortcomings in the above problems, the present application provides a double-safety anti-dropping and anti-fracture hook for an elastic belt.

In order to achieve the above purpose, the present application provides a double-safety anti-dropping and anti-fracture hook for an elastic belt, which includes a main hook body, wherein the small end of the main hook body is provided with a first connecting hole, the big end of the main hook body is provided with a second connecting hole, the second connecting hole runs through the main hook body in the radial direction, and the main hook body is also provided with a tapered hole communicated with the second connecting hole in the axial direction, and the cross section of the tapered hole goes from the big end of the main hook body to the first connecting hole; the big end of the main hook body is also provided with a notch, so that the elastic belt can enter from the position of the notch and be clamped at the tapered hole, and a connecting beam is arranged in the second connecting hole, so that a safety rope penetrating through the elastic belt can be tied on the connecting beam.

The elastic belt is hollow, and when the elastic belt is connected with the hook, the safety rope plays the role of secondary locking, which ensures that the elastic belt will not cause injury to personnel in case of releasing or fracture.

As a further improvement of the solution, the second connecting hole is in the shape of an arch, and the connecting beam is transversely mounted at the top of the arch;

In the above technical solution, the arch-shaped design conforms to the aesthetic taste, and can ensure the overall strength of the anti-dropping and anti-fracture hook.

As a further improvement of the solution, the elastic belt has a large diameter section matched with the tapered hole, the width value of the notch is smaller than the size of the elastic belt, and the distance from the upper surface of the elastic belt to the connecting beam is smaller than the height value of the large diameter section.

In the technical solution, the reasonable selection of the width value of the notch and the height value of the large diameter section makes the elastic belt basically not release under the non-artificial condition after being installed in the anti-releasing hook through elastic deformation.

As a further improvement of the solution, the elastic belt is internally provided with a tapered plug which matches the shape of the tapered hole, and the middle part of the plug is provided with a through hole for the safety rope to pass through.

In the above technical solution, the elastic belt is a hollow elastic belt with an equal cross section, and the material of the elastic belt is partially deformed by the way of the built-in plug; meanwhile, the plug is fitted and positioned at the position of the tapered hole to realize the connection between the elastic belt and the anti-dropping and anti-fracture hook.

Compared with the prior art, the present application has the beneficial effects that: the elastic belt is hollow, when the elastic belt is connected with the hook, the safety rope plays a secondary locking function, so that the elastic belt will not hurt people in the case of releasing or breaking; the second connecting hole is arch-shaped, and the arch-shaped design conforms to the aesthetics, and the overall strength of the anti-dropping and anti-fracture hook, the width value of the notch and the height value of the large diameter section can be reasonably selected, so that after the elastic belt is installed into the anti-releasing hook through elastic deformation, the releasing problem basically does not occur under the non-artificial condition; or the elastic belt makes the local material deformation of the elastic belt by the way of the built-in plug, and at the same time, the plug is fitted and positioned at the position of the tapered hole to realize the connection between the elastic belt and the anti-dropping and anti-fracture hook.

Figure 1:
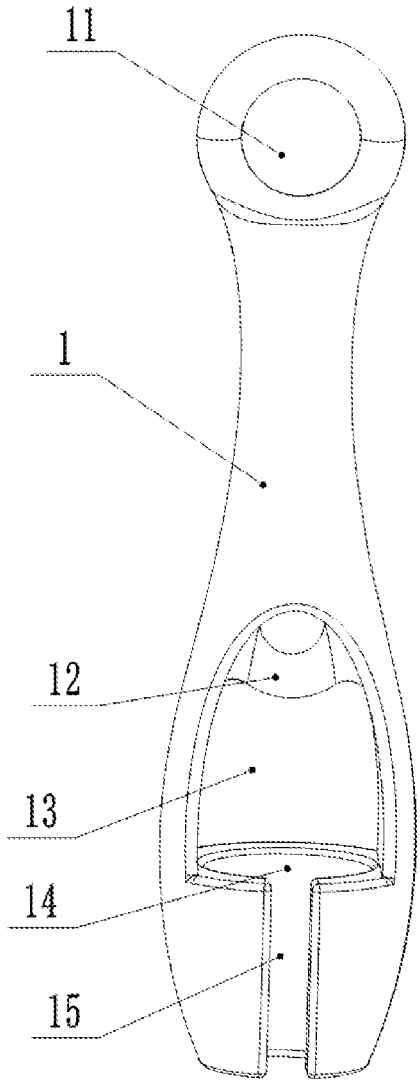
FIG. 1 is a perspective view of a double-safety anti-dropping and anti-fracture hook for an elastic belt according to the present application.
Figure 2:
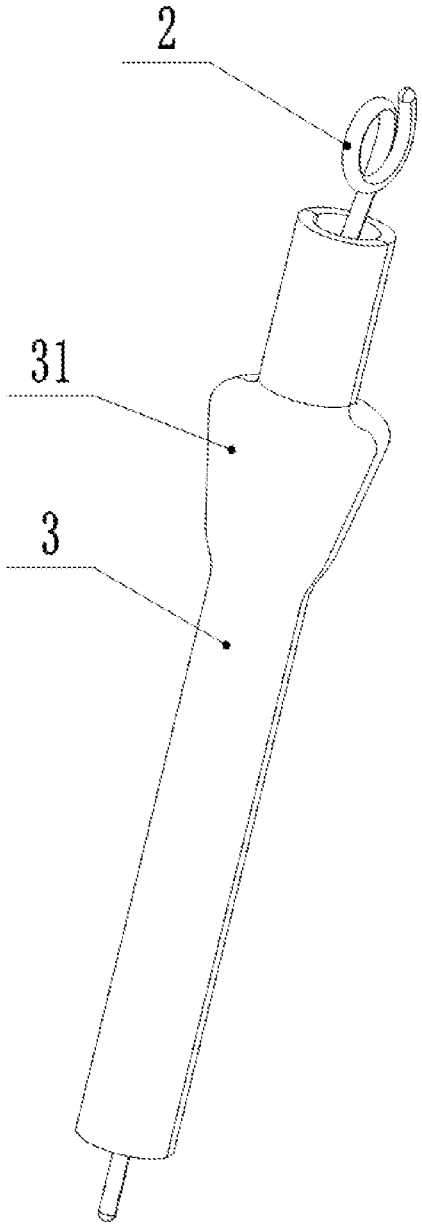
FIG. 2 is a schematic diagram of the elastic belt and safety rope.

In the drawings: 1. Main buckle body; 11. First connecting hole; 12. Connecting beam; 13. Second connecting hole; 14. Tapered hole; 15. Notch; 2. Safety rope; 3. Elastic belt; 31. Large diameter section.

DESCRIPTION OF EMBODIMENTS

Example 1: as shown in FIG. 1, an anti-dropping and anti-fracture hook for an elastic belt of the embodiment of the present application includes a main hook body 1, the small end of which is provided with a first connecting hole 11, and the big end of which is provided with a second connecting hole 13, which runs through the main hook body 1 in the radial direction; the main hook body 1 is also provided with a tapered hole 14 communicating with the second connecting hole 13 in the axial direction; the cross-section of the tapered hole 14 increases from the big end of the main hook body 1 to the direction of the second connecting hole 13, and the big end of the main hook body 1 is also provided with a notch 15, so that the elastic belt 3 can enter from the notch 15 and be clamped at the tapered hole 14, and the second connecting hole 13 is provided with a connecting beam 12, so that the safety rope 2 inserted in the elastic belt 3 can be tied on the connecting beam 12; wherein, the second connecting hole 13 is arch-shaped, and the connecting beam 12 is horizontally mounted at the top of the arch; the arch-shaped design conforms to the aesthetic taste, and can ensure the overall strength of the anti-dropping and anti-fracture hook; the elastic belt 3 has a large diameter section 31 matched with the tapered hole 14, the width value of the notch 15 is smaller than the size of the elastic belt 3, and the distance between the upper surface of the elastic belt 3 and the connecting beam 12 is smaller than the height value of the large diameter section 31; a reasonable selection of the notch width and the height value of the large diameter section makes it possible that after the elastic belt is installed into the anti-releasing hook through elastic deformation, the releasing problem will basically not occur under the non-artificial circumstances.

Example 2: The difference from Example 1 is that the elastic belt is a hollow elastic belt with an equal cross-section, and the material of elastic belt is partially deformed by the built-in plug. At the same time, the plug is fitted and positioned at the position of the tapered hole to realize the connection between the elastic belt and the anti-dropping and anti-fracture hook.

The elastic belt is hollow, and when the elastic belt is connected with the hook, the safety rope plays the role of secondary locking, which ensures that the elastic belt will not hurt people in the case of releasing or breaking; the second connecting hole is in the shape of an arch, and the arch design conforms to the aesthetic, and can ensure the overall strength of the anti-releasing hook, and the reasonable selection of the width value of the notch and the height value of the large diameter section, so that after elastic belt is installed in the anti-releasing hook through elastic deformation, the problem of releasing basically does not occur under the non-human circumstances; or the elastic belt makes the local material deformation of the elastic belt by the way of the built-in plug, and at the same time, the plug is fitted and positioned at the position of the tapered hole to realize the connection between the elastic belt and the anti-dropping and anti-fracture hook.

When in use, in order to facilitate the understanding of the present application, it will be described with reference to the attached drawings.

Figure 3:
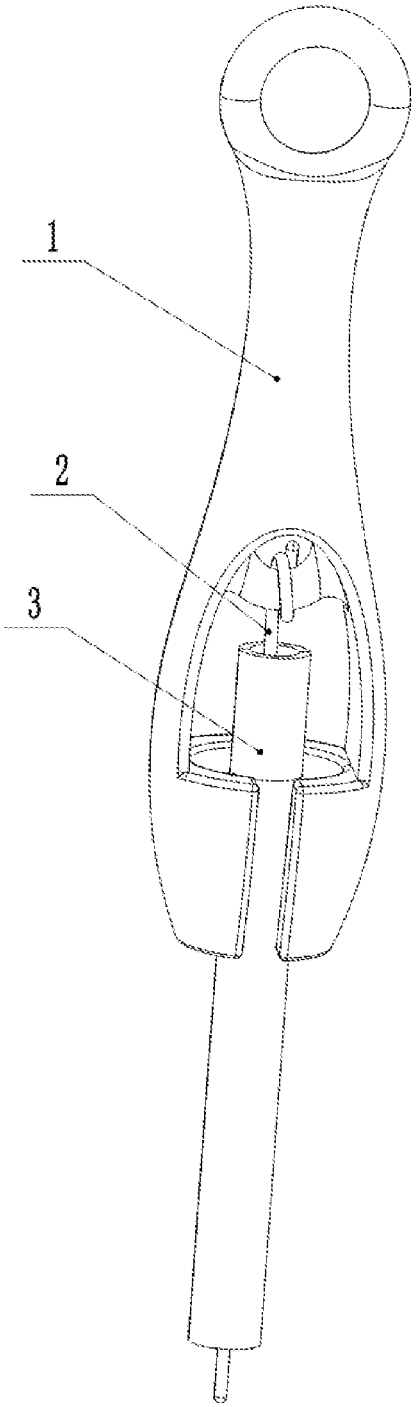
FIG. 3 is a schematic diagram of the connection between the anti-dropping and anti-fracture hook and the elastic belt.

See FIG. 3 for the usage of the hook with an elastic belt. After the elastic belt enters from the notch, it will be locked once by the large diameter section and the tapered hole. The safety rope inside the elastic belt will be tied on the connecting beam to realize the second locking. Even if the elastic belt and the safety rope are released or broken, they will not be separated from the anti-releasing hook at the same time, which will not hurt the user.

The above is only the preferred embodiment of the present application, and it is not intended to limit the present application. For those skilled in the art, the present application can be modified and varied. Any modification, equivalent substitution, improvement, etc. made within the spirit and principle of the present application shall be included in the scope of protection of the present application.

What is claimed is:

1. A double-safety, anti-dropping, and anti-fracture hook for an elastic belt, comprising a main hook body, wherein a small end of the main hook body is provided with a first connecting hole, and the big end of the main hook body is provided with a second connecting hole, and the second connecting hole runs through the main hook body in a radial direction; the main hook body is also provided with a tapered hole communicated with the second connecting hole in an axial direction; a cross section of the tapered hole increases from the big end of the main hook body to the direction of the second connecting hole, and the big end of the main hook body is also provided with a notch so that the elastic belt can enter from the notch and be clamped at the tapered hole; a connecting beam is arranged in the second connecting hole so that a safety rope penetrating through the elastic belt can be tied on the connecting beam.

2. The double-safety, anti-dropping, and anti-fracture hook for an elastic belt according to claim 1, wherein the second connecting hole is in a shape of an arch, and the connecting beam is transversely mounted at a top of the arch.

3. The double-safety, anti-dropping, and anti-fracture hook for an elastic belt according to claim 1, wherein the elastic belt has a large diameter section matched with the tapered hole, a width value of the notch is smaller than a size of the elastic belt, and a distance between an upper surface of the elastic belt and the connecting beam is smaller than a height value of the large diameter section.

4. The double-safety, anti-dropping, and anti-fracture hook for an elastic belt according to claim 1, wherein the elastic belt is internally provided with a tapered plug, the shape of which is matched with that of the tapered hole, and a through hole for the safety rope to pass through is provided in the middle of the plug.

* * * * *